US010481557B2

(12) United States Patent
Mutrux

(10) Patent No.: US 10,481,557 B2
(45) Date of Patent: Nov. 19, 2019

(54) TOURBILLON AND WATCH WITH TOURBILLON

(71) Applicant: Bucherer AG, Lucerne (CH)

(72) Inventor: Joachim Mutrux, Ste-Croix (CH)

(73) Assignee: Bucherer AG, Lucerne (CH)

( * ) Notice: Subject to any disclaimer, the term of this patent is extended or adjusted under 35 U.S.C. 154(b) by 0 days.

(21) Appl. No.: 15/713,981

(22) Filed: Sep. 25, 2017

(65) Prior Publication Data

US 2018/0088531 A1 Mar. 29, 2018

(30) Foreign Application Priority Data

Sep. 23, 2016 (CH) ..... 01245/16

(51) Int. Cl.
*G04B 17/28* (2006.01)

(52) U.S. Cl.
CPC ..... *G04B 17/285* (2013.01)

(58) Field of Classification Search
CPC ..... G04B 17/28; G04B 17/285; G04B 5/18; G04B 13/02; G04B 5/181; G04B 5/187; G04B 13/021
See application file for complete search history.

(56) References Cited

U.S. PATENT DOCUMENTS

2008/0074955 A1* 3/2008 Golay ..... G04B 17/285 368/127
2013/0333504 A1* 12/2013 Klinger ..... F16H 55/16 74/409
2017/0060090 A1* 3/2017 Heise ..... G04B 17/285

FOREIGN PATENT DOCUMENTS

| | | | |
|---|---|---|---|
| CH | 705039 | A2 | 11/2012 |
| EP | 1903408 | A2 | 3/2008 |
| EP | 1995650 | A1 | 11/2008 |
| EP | 2520985 | A1 | 11/2012 |
| WO | 01/18611 | A1 | 3/2001 |

OTHER PUBLICATIONS

International Search Report for CH 12452016, dated Feb. 20, 2017.

* cited by examiner

*Primary Examiner* — Sean P Kayes
(74) *Attorney, Agent, or Firm* — Oppedahl Patent Law Firm LLC

(57) ABSTRACT

A tourbillon (1) with a rotation cage which is rotatably arranged about a tourbillon axis is provided. The rotation cage mounts a balance wheel (3) and an escapement with an escape wheel (8) and a lever. The tourbillon is characterised in that the rotation cage comprises a bearing wheel (22) which is mounted by bearing elements (13) which engage peripherally on a running surface (11) of the bearing wheel (22).

16 Claims, 2 Drawing Sheets

TOURBILLON AND WATCH WITH TOURBILLON

Figure 1:
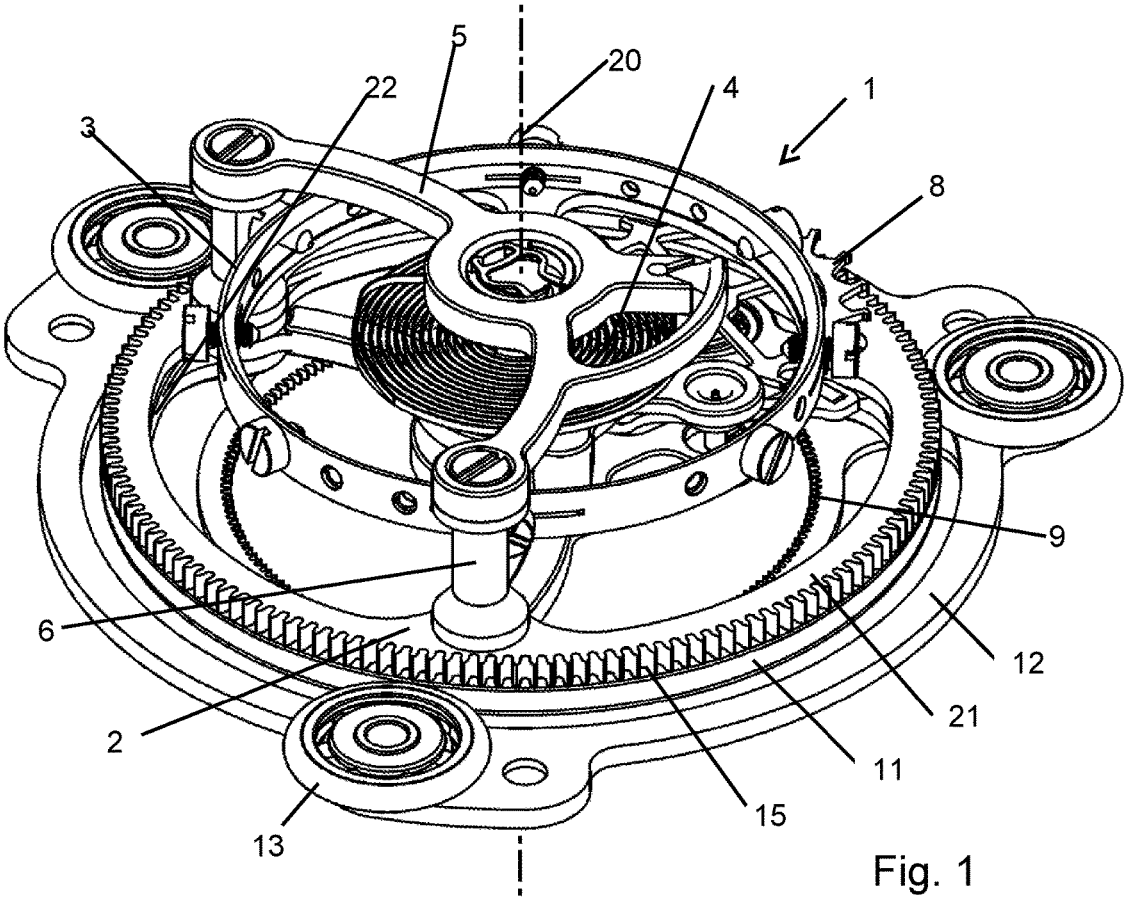

The invention relates to the field of watches with a mechanical movement (clockwork). In particular, it relates to tourbillons.

Tourbillons consist essentially of a rotation cage, on which the balance wheel, the escape wheel and the lever are arranged and which rotates relative to the watch housing, for example once per minute. One speaks of a single-axis tourbillon if the rotation cage rotates about a single axis. So-called flying tourbillons, with which the rotation cage is only held from the lower side are particularly popular, by which means the intricate mechanism of the movement is particularly well visible from the upper side. This is generally accomplished by way of the dial (face) being provided with a suitable viewing window.

However, flying tourbillons (also called cantilevered tourbillons) according to the state of the art have the disadvantage that they place very high demands on the mounting on account of the unfavourable lever effects upon the shaft, via which the mounting is accomplished, and this mounting forms a potential vulnerability. Moreover, this type of mounting results in a certain axial minimum extension, generally perpendicularly to the dial surface, which results in the respective watches having to be quite thick.

It is the object of the present invention to provide a tourbillon and a watch with a tourbillon, which overcome the disadvantages of the state of the art and which in particular at least partly have the advantages of a flying tourbillon, without having to accept its disadvantages.

These objects are achieved by the invention as is defined in the patent claims.

According to an aspect of the invention, a tourbillon with a rotation cage which is rotatably arranged about a tourbillon axis and which mounts a balance wheel and an escapement with an escape wheel and a lever is provided. The rotation cage comprises a bearing wheel which is mounted by way of bearing elements which engage peripherally on the bearing wheel.

The bearing elements in particular engage on the bearing wheel radially from the outside. Alternatively, the bearing wheel can also define an inner running surface, by which means the bearing elements can engage from the inside.

In contrast to the state of the art, the rotation cage is therefore not mounted by a shaft which is attached concentrically to the tourbillon axis and for its part is mounted by two bearings below the rotation cage or by way of a bearing below and above the rotation cage in each case, but along the periphery of the bearing wheel, said bearing wheel for example being able to have a similarly large circumference as the rotation cage as a whole. Unfavourable lever forces having a much reduced extent are to be expected on account of this, and in particular it is sufficient for the mounting to only be effected at a single axial position and several bearings which are arranged at an axial distance to one another are not therefore necessary. For this reason, the axial dimension of the tourbillon—thus its depth—can be reduced in comparison to the state of the art. As a whole, much flatter designs therefore become possible.

The bearing elements are not movable relative to the housing for example in the peripheral direction, but are each rotatable about a rotation axis, by which means the bearing wheel rolls on the bearing elements given a rotation of the rotation cage. The bearing elements can be for example ball bearing elements (i.e. comprise a ball bearing, for example by way of them forming a ball bearing). Such comprise for example an inner ring which is assembled in a fixed manner with regard to the housing, an outer roller and a plurality of balls between the ring and the roller, by which means the roller can rotate relative to the ring with a low resistance.

In particular, precisely three bearing elements can be present, and these can be arranged distributed in a roughly uniform manner in the peripheral direction.

At least one of the bearing elements can be resiliently arranged i.e. be pressed against the peripheral running surface of the bearing wheel on account of a spring force. For example, one of the bearing elements can be assembled on a rocker which is pivotable about a rocker axis and upon which a spring acts, so that the bearing element is pressed against the running surface. The resilient arrangement of a bearing element can also absorb energy which arises on impacts and moreover acts in a compensating (equalising) manner.

If three bearing elements are present, in particular two of these can be arranged in a fixed manner with respect to the housing and one can be arranged resiliently in radial directions.

The presence of more than three bearing elements is also not ruled out. Four, five or even more bearing elements can also be used, wherein then for example several of the bearing elements can be resiliently arranged.

Apart from ball bearings, other bearing elements are also considered, for example rollers which for their part are mounted by plain bearings, or the bearing elements can themselves also be designed as plain bearings, for example as jewels. As a further alternative, the bearing elements can also be designed as balls or rollers which are guided in a corresponding groove of the housing or of a base, so that the rotation cage as a complete part can be considered as a roller (inner or possibly outer ring) of a ball bearing. What is important is merely the fact that a mounting is possible from the periphery and that the frictional losses are not too large.

The bearing wheel forms a peripheral, radially outer or possible inner running surface, upon which the bearing elements engage. The running surface can be designed such that it has no structure in the peripheral direction but is smooth, i.e. that is constant as a function of the azimuth angle and in particular has no toothing or likewise, so as to achieve a smooth rolling of the bearing elements.

However, the running surface can form a peripheral groove or peripheral tongue which interacts with a complementary structure of the bearing elements, in order to fix the rotation cage in the axial direction. The complementary structure of the bearing elements however with regard to their shaping and dimensioning can differ from the structure of the running surface such that generally only two contact elements are formed per bearing element. This can be accomplished for example by way of the respective groove having no curvature or a smaller curvature than the corresponding surface of the engaging element, in the region of the contact with the element (roller; spring) which engages into it.

In particular, the running surface of the bearing wheel is arranged peripherally with respect to the complete rotation cage, i.e. the running surface can essentially form an outermost surface of the complete rotation cage. The diameter of the bearing wheel or the diameter of the running surface can correspond for example to the diameter of the rotation cage or at least 70% or at least 80% of this diameter. Torques which possibly act upon the rotation cage can be transmitted onto the housing with little force effort by way of this.

The tourbillon generally also comprises a rotation cage cog, on which a power wheel of the remaining movement engages and via which this power wheel takes up the rotation movement of the tourbillon and therefore the time information. This cog—as is known per se—can likewise form a peripheral surface of the rotation cage. The rotation cage cog can alternatively also comprise an inner toothing. The bearing wheel and the rotation cage cog are generally designed in a rotationally fixed manner relative to one another. The bearing wheel and the rotation cage cog—as well as possibly other elements of the rotation cage—can also be together as one piece, i.e. be formed by one and the same element.

The tourbillon can moreover comprise a base, on which the bearing elements or at least the non-resilient bearing elements are assembled. Such a base can be installed into the housing of the watch, for example by way of screwing. The tourbillon as a whole can therefore form a module which is manufactured and installed into the housing as one entity.

Such a base can also comprise a toothing which is fixed with regard to the housing and into which a pinion coupled to the escape wheel engages, in order to drive this escape wheel on account of the rotation movement of the tourbillon.

A watch according to the invention, in particular a wrist watch or a pocket watch, comprises apart from a tourbillon of the described type further movement parts, in particular a spring housing or likewise as an energy store, and a train for transmitting the drive force from the energy store onto the tourbillon and for stepping down the rotation motion of the tourbillion, as well as display means (hands, dial) for showing the time, for which a motion work can also be present in the manner known per se. One or more intricacies for displaying further information, in particular the date etc. can also be present.

In particular, the train can comprise a power wheel which is in engagement with the rotation cage cog.

The dial can comprise a viewing window, through which the tourbillon is at least partly visible. The user can see much of the mechanism due to the cantilevered (flying) arrangement according to the invention, and despite this the complete movement can be very flat and the watch therefore accordingly elegant.

Figure 2:
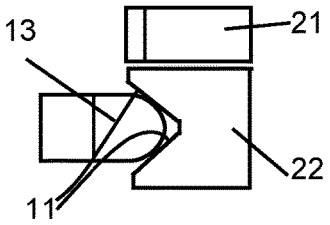
Figure 3:
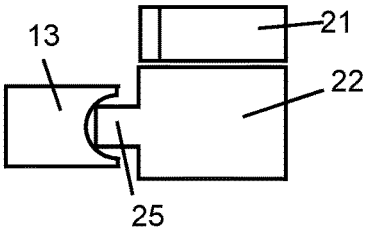
Figure 4:
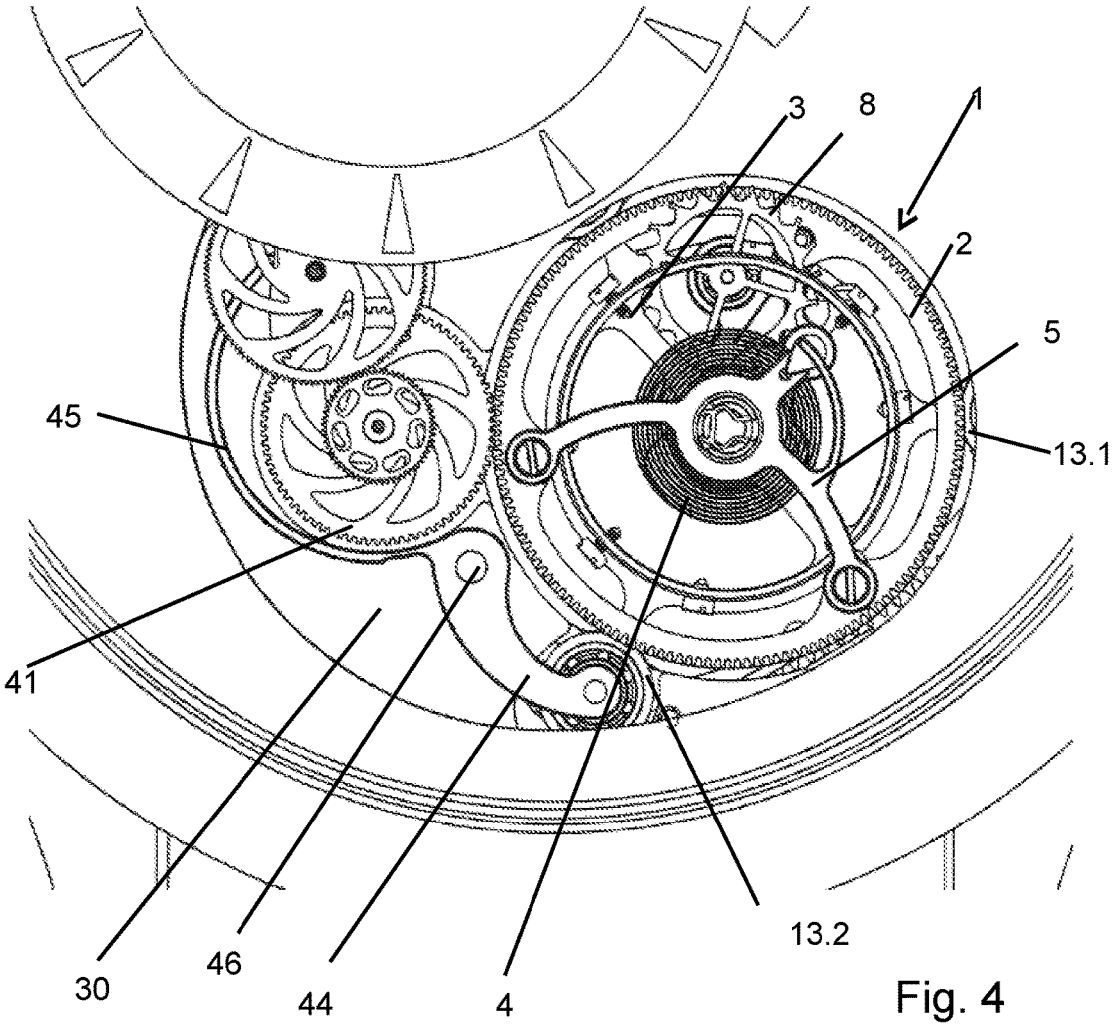

The subsequent drawings represent exemplary embodiments of the invention, by way of which the invention is described in detail. The same reference numerals in the drawings indicate the same or analogous elements. The drawings show in:

FIG. 1 a view of the tourbillon according to the invention;

FIGS. 2 and 3 in each case schematically, a detail of the guidance of the bearing wheel by one of the bearing elements;

FIG. 4 a detail from a view of a watch provided with the tourbillon.

The functioning manner and the implementation of the invention are hereinafter shown by way of different exemplary embodiments. It is to be understood that the invention is not restricted to these embodiments, but also includes other embodiments which are in concordance with the claims.

FIG. 1 shows a tourbillon 1 which is assembled on a base 12 which is fixed with regard to the housing. The tourbillon 1 comprises a rotation cage which rotates relative to the housing about a tourbillon axis 20, for example with one revolution per minute. The rotation cage can thereby serve as a second hand in a manner known per se, or such a second hand can be coupled to the rotation cage. The details concerning the time display are not essential to the invention and are not discussed further in this text.

Apart from a rotation cage platform 2, the rotation cage comprises a balance wheel bridge 5 which is fastened to this platform by two fastening pins 6. A balance staff of the balance wheel 3 is mounted between the rotation frame platform 2 and the balance wheel bridge 5, and specifically coaxially with the tourbillon axis 20 in the shown embodiment. The balance wheel 3 together with a spiral spring 4, in a manner known per se forms an oscillation system which likewise in a manner known per se interacts with an escapement which is present in the rotation cage and of which in FIG. 1 the lever is largely covered and the escape wheel 8 is only partly visible. The escape wheel 8 drives the oscillation system via the lever and thereby per oscillation rotates by a rotation angle which is defined by the distance of the escape wheel teeth.

The drive of the escape wheel 8 is effected by way of an escape wheel pinion which is not visible in FIG. 1 and which is coupled onto the escape wheel engaging into a toothing 9 which is fixed with regard to the housing and thus rolling on this toothing 9 due to the rotation of the rotation cage, on which the escape wheel is assembled. In the represented embodiment example, the toothing 9 which is fixed with regard to the housing is formed on that disc which also forms the base. The base and/or the toothing fixed with regard to the housing can however also be formed by the watch housing itself.

The rotation cage for its part is driven by a power wheel which can be considered as a second fourth wheel which is not visible in FIG. 1 and which for example engages into an outer toothing 15 of the rotation cage platform 2 which is well visible in FIG. 1.

The rotation cage platform 2 forms an outer, peripheral running surface 11. For this purpose, in the represented embodiment example, the rotation cage platform below a rotation cage cog 21 which comprises the outer toothing 15 also comprises a rotation cage bearing wheel 22 with the peripheral running surface 11. Ball bearing elements 13 which are fastened to the base 12 are arranged radially outside this running surface. The ball bearing elements comprise an outer roller, on which the running surface 11 rolls given a rotation of the rotation cage. As a whole, exactly three of the ball bearing elements 13 are present and these are distributed at least approximately uniformly in the peripheral direction.

FIG. 2 shows a schematic cross section through an outer roller of a ball bearing element 13 and through the peripheral region of the rotation cage platform. The ball bearing element 13 mounts the rotation cage platform and secures its axial and radial position due to the fact that the rotation cage platform 2 at its periphery forms a groove, into which the roller engages—the running surface 11 as a whole is designed approximately V-shaped in cross section. The rotation cage platform 2 is therefore mounted by the three ball bearing elements 13 in a suspended, i.e. cantilevered manner. In the present example there are two contact points per ball bearing element on account of the roughly V-shaped design of the groove which forms the running surface 11 and on account of the convex shape of the roller, by which means the resistance is minimised.

As an alternative to a groove, the running surface can also comprise a projection 25 which engages into a corresponding groove of the ball bearing element 13, which is represented schematically in FIG. 3. The principle of the axial and radial mounting functions analogously.

The running surface can be coated with wear-resistant material which minimises the rolling friction, for example diamond-like carbon (DLC). Otherwise, the applied materials can be metals or composite materials, in particular special plastics, or also ceramics, which per se are valid as being suitable for the described purpose, for example high-grade steels, titanium alloys, etc.

As a further variant, the running surface can also be an inner running surface, i.e. the bearing wheel forms a peripheral, revolving ring, on whose inner side the running surface is formed, and the bearing elements engage on the running surface from the inside.

FIG. 4 in a detailed manner shows an upper view of a watch, whose dial comprises a window 30, through which the movement and in particular the tourbillon is partly visible. Apart from the tourbillon 1, one can recognise the power wheel 41 as well as further cogs of the movement which interact with this power wheel and by way of which on the one hand the drive energy is transmitted from a non-shown spring onto the power wheel and on the other hand the rotation movement of the rotation cage is stepped down, in order to control the forwards drive of the minute hand and hour hand, as well as, if required, one or more further intricacies (date display etc.).

FIG. 4 also shows the possibility, apart from two fixedly assembled ball bearing elements 13.1, of providing a ball bearing element 13.2 which is resiliently mounted relative to the housing. The resiliently mounted ball bearing element 13.2 is pressed against the running surface 11 by a resiliently mounted rocker 44. This type of spring mounting or suspension can absorb energy which occurs with impacts and acts in a compensating manner, for example given different thermal expansions.

A pivot pin 46 as well as a spring 45 which presses the ball bearing element against the running surface 11 is provided for the mounting of the rocker 44.

The tourbillon 1 according to FIG. 1 including the base can be manufactured as a module and be insertable into a housing of the watch, for which screw holes visible in FIG. 1 next to each ball bearing element can serve. Only a single mechanical interface to the remaining components of the movement is necessary, and this is formed at the tourbillon side by the rotation cage cog.

The invention was described by way of a single-axis tourbillon. However, with suitable adaptations it can also be applied to multi-axis tourbillons.

The invention claimed is:

1. A tourbillon for a watch, the tourbillon comprising a rotation cage rotatably arranged about a tourbillon axis, the rotation cage mounting a balance wheel and an escapement with an escape wheel and a lever, the rotation cage further comprising a bearing wheel, and the tourbillon further comprising a plurality of bearing elements, wherein the bearing wheel is mounted by the bearing elements, wherein the bearing elements engage peripherally on a running surface of the bearing wheel, and wherein at least one of the bearing elements is mounted on a rocker subject to a spring force of a spring.

2. The tourbillon according to claim 1, wherein the running surface forms an outer surface portion and the bearing elements engage on the bearing wheel radially from the outside.

3. The tourbillon according to claim 1, wherein the bearing elements have a fixed position in the peripheral direction but are rotatable each about a rotation axis, whereby the bearing wheel rolls on the bearing elements give a rotation of the rotation cage.

4. The tourbillon according to claim 3, wherein the bearing elements each comprise a ball bearing.

5. The tourbillon according to claim 3, wherein the bearing elements each comprise a slidingly mounted roller.

6. The tourbillon according to claim 1, wherein the bearing elements form a plain bearing.

7. The tourbillon according to claim 1, wherein precisely three of the bearing elements are present.

8. The tourbillon according to claim 1, wherein the running surface forms a tongue and wherein the bearing elements comprise a groove, into which the tongue engages, in order to form an axial and radial guide.

9. The tourbillon according to claim 1, wherein the running surface forms a groove, and wherein the bearing elements engage into the groove, in order to form an axial and radial guide.

10. The tourbillon according to claim 1, comprising a rotation cage cog, on which a power wheel of a remaining movement engages and via which this power wheel takes up the rotation movement of the rotation cage and, with this, time information, wherein the rotation cage cog is connected to the bearing wheel in a rotationally fixed manner and is arranged axial above or below this.

11. The tourbillon according to claim 1, comprising a base equipped to be assembled in a fixed manner relative to a housing of the watch in which the tourbillon is mounted, the base comprising a toothing into which toothing a pinion coupled to the escape wheel engages, in order to drive this escape wheel given a rotation movement of the rotation cage.

12. The tourbillon according to claim 1, comprising a base equipped to be assembled in a fixed manner relative to a housing of the watch in which the tourbillon is mounted, wherein at least one of the bearing elements is assembled on the base.

13. The tourbillon according to claim 1, wherein the bearing elements are designed in a movable and rolling manner in the peripheral direction.

14. The tourbillon according to claim 13, wherein the bearing elements are balls.

15. A watch, comprising a tourbillon according to claim 1, as well as an energy store and a train for transmitting drive force from the energy store onto the tourbillon and for stepping down the rotation movement of the rotation cage, as well as display elements for displaying the time.

16. The watch according to claim 15, wherein the watch is a wrist watch or a pocket watch.

* * * * *